US005259521A

United States Patent [19]

Shaffer et al.

[11] Patent Number: 5,259,521

[45] Date of Patent: Nov. 9, 1993

[54] TACK RACK

[76] Inventors: Don T. Shaffer, 5328 W. National Rd., Clayton, Ohio 45315; Emmert A. Milyard, 17 Jefferson St., Brookville, Ohio 45309

[21] Appl. No.: 771,485

[22] Filed: Oct. 4, 1991

[51] Int. Cl.[5] ..... A47B 43/00

[52] U.S. Cl. ..... 211/199; 211/13; 211/181

[58] Field of Search ..... 211/188, 199, 198, 169, 211/13, 195, 90, 181, 150; D30/143; 119/7, 85; 54/44.1, 84

[56] References Cited

U.S. PATENT DOCUMENTS

| | | | |
|---|---|---|---|
| D. 255,611 | 6/1980 | Lone | D30/143 |
| D. 316,919 | 5/1991 | Reep | D30/143 |
| 580,383 | 4/1897 | Duffee | 211/199 X |
| 619,050 | 2/1899 | Shepherd | 211/199 |
| 935,507 | 9/1909 | Hill et al. | 211/181 X |
| 1,039,696 | 10/1912 | Burton | 211/150 X |
| 1,713,295 | 5/1929 | Miller | 211/150 X |
| 1,752,985 | 4/1930 | Huffman | 211/181 X |
| 2,293,275 | 8/1942 | Boltz | 211/199 X |
| 2,311,932 | 2/1943 | Deckard | 211/100 X |
| 3,315,819 | 4/1967 | Kingsbery | 211/13 X |
| 3,330,418 | 7/1967 | Schneider | 211/47 |
| 3,351,211 | 11/1967 | Best | 211/169 |
| 3,379,484 | 4/1968 | Kling | 211/169 X |
| 3,780,971 | 12/1973 | De Filipps | D30/143 X |
| 4,357,881 | 11/1982 | De Long | 211/158 X |
| 4,542,832 | 9/1985 | Minick et al. | 211/181 X |
| 4,634,010 | 1/1987 | Otema | 211/90 X |
| 5,031,783 | 7/1991 | Goudreau | 211/181 |
| 5,087,105 | 2/1992 | White | 211/13 X |
| 5,139,155 | 8/1992 | Laxson | 211/169 |

FOREIGN PATENT DOCUMENTS

| | | | |
|---|---|---|---|
| 1086173 | 10/1967 | United Kingdom | 211/2 |

*Primary Examiner*—David A. Scherbel
*Assistant Examiner*—Korie H. Chan
*Attorney, Agent, or Firm*—R. William Graham; H. Stanley Muir, III

[57] ABSTRACT

This invention relates to a portable Tack Rack having sturdy framework construction and to a collapsible equestrian Tack Rack which may be readily assembled and disassembled. The Tack Rack includes two (2) rigid rectangular frames connected such that the frames fold one against the other and unfold such that at least one of the frames sit upright from a support surface. A plurality of extendable members lockably connect to the upright frame such that when extended the members are generally parallel to the support surface, and at least one of the members is adapted to adequately support a saddle placed thereon.

11 Claims, 2 Drawing Sheets

TACK RACK

BACKGROUND OF THE INVENTION

1. Field of Invention

This invention relates to a portable rack having sturdy framework construction and, more particularly, to a collapsible equestrian tack rack which may be readily assembled and disassembled.

2. Description of the Prior Art

There is often a need or desire when at a horse show polo match or other equestrian event, to have a device for holding and arranging riding gear such as saddles, saddle blankets, combs, bridles, halters, and grooming paraphernalia, all of which may be referred to as tack. Unfortunately, there has yet to be a suitable means for hanging tack, particularly one which can be moved from place to place.

Presently and most commonly used are riggings consisting of nails and rope. Other attempts at providing a portable tack rack have met with little success. The reasons vary from expense, to difficulty in assembly, to undesirable consumption of space. There remains a need for a portable, relatively inexpensive, readily collapsible and easy to assemble tack rack.

SUMMARY OF INVENTION

The present invention provides for a tack rack which meets the aforementioned need. A particularly suitable temporary storage of tack is provided by the present invention which allows for user-friendly set-up through its folding, unfolding and collapsible aspect.

The present invention provides a portable tack rack. The tack rack comprises two rigid rectangular frames hingedly connected such that the frames fold one against the other and unfold such that at least one of the frames sit upright from a support surface, and a plurality of extendable members lockably connected to the upright frame such that when extended the members are generally parallel to the support surface, and wherein at least one of the members is adapted to adequately support a saddle placed thereon.

More particularly, the present invention provides a portable tack rack having a first and a second rigid frame, each having a first and a second lateral portion. The second lateral portion of the second frame is hingedly connected to the first lateral portion of the first frame. The frames are foldable one upon the other, by virtue of the hinged connection, and unfoldable to a predetermined obtuse angle.

Across the second frame, a first transverse member is connected at each of its ends to the first and second lateral portions, respectively, of the frame. Likewise, a second transverse member also extends across the second frame and is connected at each of its ends to the first and second lateral portions of the frame.

A generally U-shaped member is pivotally connected at its open ends to the first transverse member. A support member connects the U-shaped member and the second transverse member such that the U-shaped member is foldable upon the second frame and lockingly pivotable to a position generally perpendicular to the second frame member. The U-shaped member in the perpendicular position provides a bracket on which a saddle may be placed. With removal of tack, the U-shaped member is foldable upon the second frame, and the first and second frames foldable upon one another to provide a portable tack rack which readily collapses to a compact portable unit.

DETAILED DESCRIPTION OF THE PREFERRED EMBODIMENTS

Figure 1:
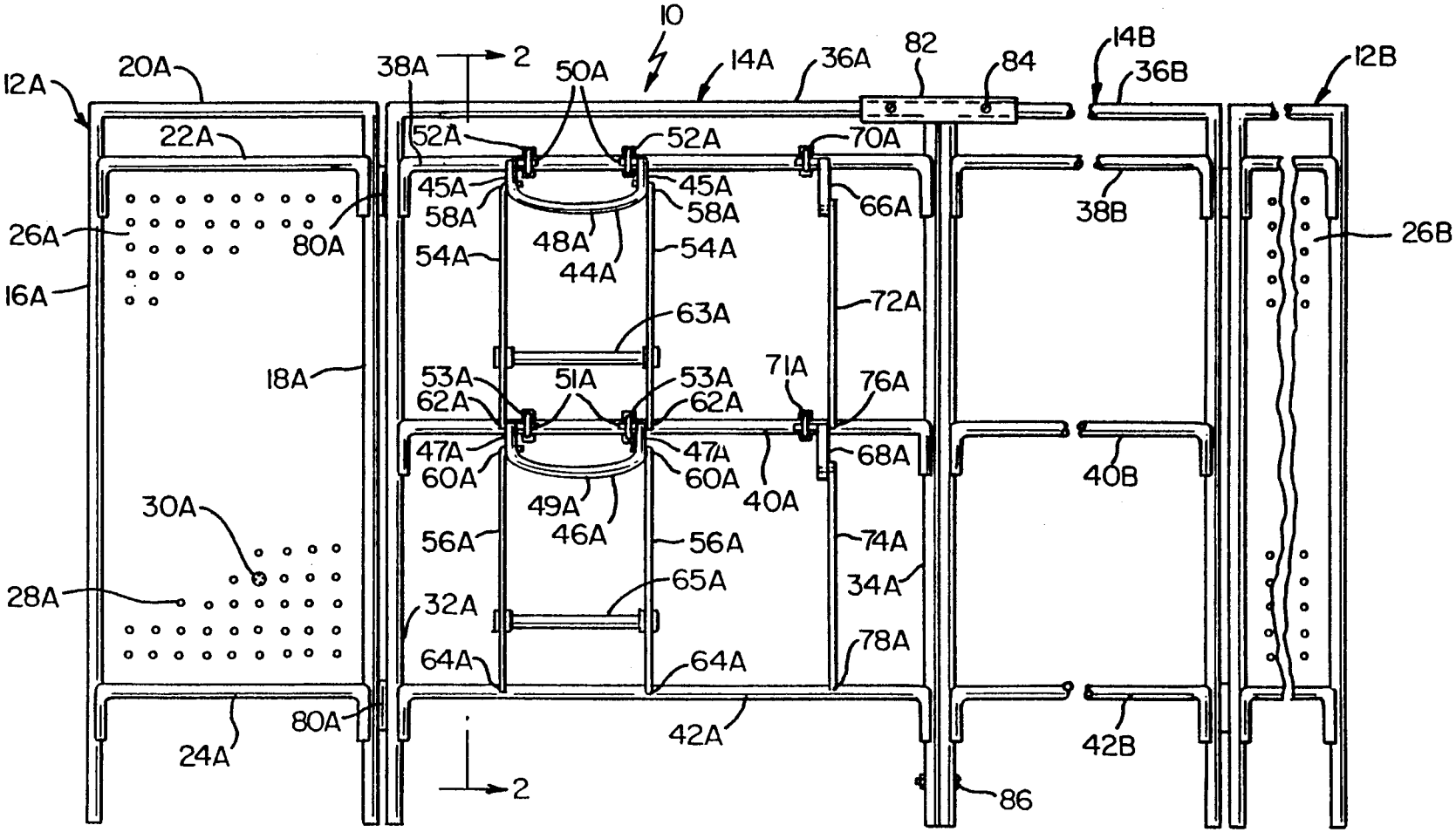
FIG. 1 is a front view of the present invention.

The aforementioned portable tack rack 10 is depicted in FIG. 1 and comprises rigid frames 12A and 12B and 14A and 14B. Rigid frame 12A is generally planar and includes lateral portions 16A and 18A and end connecting member 20A for connecting an end of each lateral portion 16A and 18A. Transverse members 22A and 24A are laterally spaced and connect lateral portions 16A and 18A of frame 12A. Rigid panel 26A is connected to the frame portion formed by transverse members 22A and 24A and lateral portions 16A and 18A. Rigid panel 26A includes a plurality of holes 28A adapted to receive pegs 30A or the like so that tack accessories such as bridles, halters, combs and grooming paraphernalia can be hung therefrom. Rigid frame 12B is similarly formed.

Rigid frame 14A is generally planar and includes lateral portions 32A and 34A and end connecting member 36A for connecting an end of each of lateral portion 32A and 34A. Transverse members 38A, 40A and 42A are laterally spaced from one another with member 42A being further laterally spaced from member 38A than member 40A. Transverse members 38A, 40A and 42A connect lateral portions 32A and 34A of frame 14A.

Generally U-shaped members 44A and 46A have side portions 45A and 47A, respectively. Attached to the side portions 45A and 47A are extensions 50A and 51A, respectively, which are pivotally connected to transverse members 38A and 40A, respectively, by U-shaped connectors 52A and 53A. Support members 54A and 56A have one end 58A and 60A, respectively, end 58A pivotally connected to side portions 45A of U-shaped member 44A and end 60A likewise pivotally connected to side portions 47A of U-shaped member 46A. Support members 54A and 56A each have at their opposite termination a hook-shaped member 62A and 64A, respectively, for lockingly connecting support members 54A and 56A to transverse members 40A and 42A, respectively. Transverse braces 63A and 65A connect between support members 54A and 56A, respectively, to aid the stability of U-shaped members 44A and 46A.

Alternatively, extensions 50A and 51A, U-shaped connectors 52A and 53A, support members 54A and 56A, and transverse braces 63A and 65A could be replaced by other means permitting U-shaped members 44A and 46A to collapse against frame 14A or be locked in a position generally perpendicular thereto. For example, this could be accomplished by a rachet-type releasable hinge connecting side portions 45A and 47A, to transverse members 38A and 40A, respectively.

Figure 2:
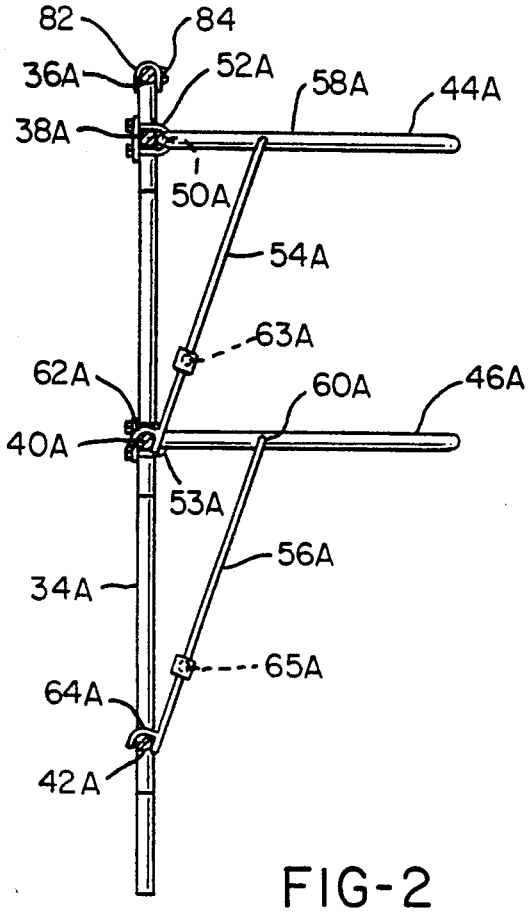
FIG. 2 is a side view of part of the present invention.

In their supported position, as seen in FIG. 2, U-shaped members 44A and 46A provide suitable saddle rests, being generally perpendicular to frame 14A and thus generally parallel to the ground. It is important that ends 58A and 60A of support members 54A and 56A are pivotally connected to inner portions of side portions 45A and 47A, respectively, to minimize potential damage to the saddles.

Figure 4:
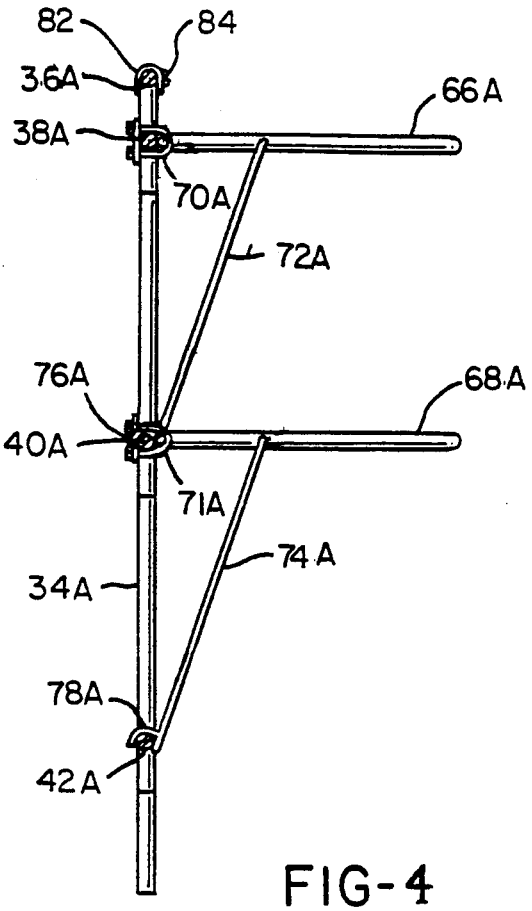
FIG. 4 is a side view of part of the present invention.

Referring to FIGS. 1 and 4, L-shaped members 66A and 68A are pivotally connected to transverse, members 38A and 40A by respective U-shaped connectors 70A and 71A, the L-shaped members being axially spaced from U-shaped members 44A and 46A, respectively. U-shaped connectors 52A, 53A, 70A and 71A are readily adjustable to allow for desired axial positioning of U-shaped members 44A and 46A and L-shaped members 66A and 68A. Support members 72A and 74A each have a hook-shaped end 76A and 78A, respectively, for lockingly connecting support members 72A and 74A to transverse members 40A and 42A, respectively. Frame 14B is similarly formed. The L-shaped members 66A and 68A provide suitable blanket racks when locked in their extended positions generally perpendicular to frame 14A and thus generally parallel to the ground.

Figure 3:
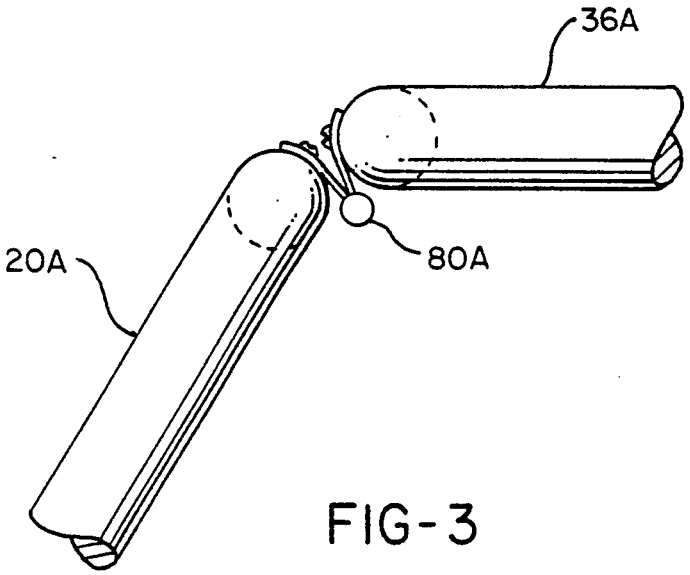
FIG. 3 is an enlarged portion of FIG. 1 as viewed from the top.

Rigid frame 12A and rigid frame 14A are connected at lateral portions 18A and 32A by arcuate hinges 80A. As seen in FIG. 3, arcuate hinges 80A are formed in a manner to allow frame 12A to be foled upon frame 14A and unfolded such that frame 12A and frame 14A form a predetermined obtuse angle which allows ample access to use U-shaped members 44A and 46A and L-shaped members 66A and 68A while maintaining adequate structural balance even though lateral portions 16A, 18A, 32A and 34A are positioned generally perpendicular to the ground.

Frame 12B and 14B can be similarly connected. Alternatively, frame 12B could be connected to frame 14A in a similar fashion to that of the connection described between frame 12A and 14A.

In the preferred embodiment, frames 12A and 14A and 12B and 14B are interconnected, wherein frames 14A and 14B are connected by U-plate 82, the connection strengthened by bolts 84 and eye bolt 86 tightened against end connecting members 36A and 36B as seen in FIG. 1. U-plate 82 and bolt 86 maintain frame 14A and 14B in a substantially stable planar position when assembled while providing easy assembly and disassembly.

Frames 12A, 12B, 14A and 14B are preferably made of a lightweight metal tubing, such as aluminum or alloy. Panels 26A and 26B can be made from suitable lightweight metal or cellulose material such as compressed board.

The present invention has been set forth above in a specific embodiment. However, it will be readily apparent to one skilled in the art that many modifications, alternations, and derivatives exist and the specific embodiment is not meant to limit the scope of the present invention.

What is claimed is:

1. A portable tack rack in combination with at least one saddle comprising:

two rigid rectangular frames;

a pair of arcuate hinges which hingedly connect said frames such that said frames fold one against the other and unfold to a predetermined angle such that an edge of each said frame cooperate to form a base which allows said rack to be self supporting and capable of supporting the saddle and stand upright relative to a reference surface;

a u-shaped saddle support member of a size and configuration to receive and conform to a bottom surface of the saddle, said u-shaped saddle support member hingedly attached to one of said frames for movement thereon and having a support brace member hinged to and extending below said saddle support member for movement thereon, said support brace member having an engaging portion for locking said saddle support member in position generally perpendicular to said one upright frame and being disengagable from said frame for collapsing said saddle support member and said support brace against said frame; and a plurality of extendable members lockably connected to at least one of said upright frames such that when extended said extendable members are generally perpendicular thereto, said extendable members having support braces hingedly attached thereto for movement thereof each of said support braces of said extendable members having an engaging portion for locking said extendable members in position generally perpendicular to said upright frame, and being disengagable from said frame for collapsing said extendable members and said support braces of said extendable members against said frame.

2. A portable self supporting tack rack in combination with at least one saddle, comprising:

a first rigid rectangular frame having a first lateral portion and a second lateral portion and means for connecting said first lateral portion and said second lateral portion;

a second rigid rectangular frame having a first lateral portion and a second lateral portion, a first transverse member connecting said first lateral portion and said second lateral portion of said second rigid rectangular frame, and a second transverse member laterally spaced from said first transverse member and connecting said first lateral portion and said second lateral portion of said second rigid rectangular frame;

a pair of arcuate hinges which hingedly connect said first lateral portion of said second rigid rectangular frame to said first lateral portion of said first rigid rectangular frame such that said frames fold one against the other and unfold to a predetermined angle such that an edge of each said frame cooperate to form a base to stand upright relative to a reference surface and allow said rack to be self supporting when supporting the saddle;

a first generally u-shaped saddle support member having a first side portion, and a second side portion, said side portions each having an end pivotally connected to said first transverse member, wherein said u-shaped saddle support member is of a size and configuration to conform to and receive a bottom surface of the saddle; and a first support member having an end pivotally connected to said u-shaped saddle support member and another end extending below said u-shaped saddle support member which is lockingly connected to said second transverse member.

3. The tack rack of claim 2, further comprising:

a first rigid panel connected to said first lateral portion and said second lateral portion of said first frame, said first panel having a plurality of holes; and a plurality of pegs removably insertable in said holes for holding tack to form a tack board.

4. The tack rack of claim 2, further comprising:

an L-shaped member having an end pivotally connected to said first transverse member adjacent said first U-shaped member; and a second support member having an end pivotally connected to said L-shaped member and another end lockingly connectable to said second transverse member.

5. The tack rack of claim 2, further comprising:

a third transverse member laterally spaced from said second transverse member and connected at an end to said first lateral portion of said said second rigid rectangular frame and connected at another end to said second lateral portion of said second rigid rectangular frame, said third transverse member being further laterally spaced from said first transverse member than said second transverse member;

a second generally u-shaped saddle support member having a first side portion, and a second side portion, said side portions each having an end pivotally connected to said second transverse member, wherein said second u-shaped saddle support member is of a size and configuration to conform to and receive the bottom surface of the saddle; and a third support member having one end pivotally connected to said u-shaped saddle support member and another end extending below said second u-shaped saddle support member which is lockingly connected to said third transverse member.

6. The tack rack of claim 5, which further comprises:

an L-shaped member having an end pivotally connected to said second transverse member adjacent said second U-shaped member; and a fourth support member having one end pivotally connected to said L-shaped member and another end lockingly connectable to said third transverse member.

7. The tack rack of claim 2, wherein said another end of said first support member is further characterized to include a hook-shaped portion.

8. The tack rack of claim 2, which further includes:

a third rigid rectangular frame having a first lateral portion and a second lateral portion, and means connecting said lateral portions of said third frame;

a pair of arcuate hinges which hingedly connect said first lateral portion of said third rigid rectangular frame to said second lateral portion of said second rigid rectangular frame such that said frames fold one against the other and unfold to a predetermined angle such that an edge of said third rigid rectangular frame cooperates with said base in maintaining structural balance of said tack rack;

a second rigid panel connected to said first lateral portion and said second lateral portion of said third frame, said second panel having a plurality of holes; and a plurality of pegs removably insertable in said holes for holding tack to form a tack board.

9. The tack rack of claim 2, further comprising:

a third rigid rectangular frame having a first lateral portion and a second lateral portion, a third transverse member connecting a first lateral portion and a second lateral portion of said third rigid rectangular frame, and a fourth transverse member laterally spaced from said third transverse member and connecting said first lateral portion and said second lateral portion of said third rigid rectangular frame;

a fourth rigid rectangular frame having a first lateral portion and a second lateral portion and means for connecting said first lateral portion and said second lateral portion of said fourth rigid rectangular frame;

a pair of arcuate hinges which hingedly connect said first lateral portion of said fourth rigid frame to said first lateral portion of said third rigid rectangular frame such that said frames fold one against the other and unfold to a predetermined angle such that an edge of each said third and fourth frame cooperate to form a base and maintain balance of said tack rack and to stand upright relative to a reference surface and aid said rack to be self supporting when supporting the saddle;

a second generally u-shaped saddle support member having a first side portion, and a second side portion, said side portions each having an end pivotally connected to said third transverse member, wherein said u-shaped saddle support member is of a size and configuration to conform to and receive the bottom surface of the saddle;

a second support member having an end pivotally connected to said second u-shaped saddle support member and another end extending below said u-shaped saddle support member which is lockingly connected to said fourth transverse member of said said third rigid rectangular frame; and connector means for readily connecting said second rigid rectangular frame and said third rigid rectangular frame.

10. The tack rack of claim 9, further comprising a second rigid panel connected to said first lateral portion and said second lateral portion of said fourth frame, said second panel having a plurality of holes and a plurality of pegs removably insertable in said holes for holding tack to form a second tack board.

11. The tack rack of claim 9, further comprising;

an L-shaped member having an end pivotally connected to said first transverse member of said third frame adjacent said second U-shaped member; and a second support member having an end pivotally connected to said L-shaped elongated member and another end lockingly connectable to said second transverse member.

* * * * *